US006076507A

United States Patent [19]

Blizard et al.

[11] Patent Number: 6,076,507

[45] Date of Patent: Jun. 20, 2000

[54] PUMP SYSTEM FOR PREVENTING HOT START KNOCK IN A DIESEL ENGINE

[75] Inventors: Norman C. Blizard; Thomas Kozlowski; Raymond J. Amlung; George L. Muntean, all of Columbus; William D. Daniel, Scipio, all of Ind.

[73] Assignee: Cummins Engine Company, Inc., Columbus, Ind.

[21] Appl. No.: 09/143,097

[22] Filed: Aug. 28, 1998

Related U.S. Application Data

[60] Provisional application No. 60/056,236, Aug. 28, 1997.

[51] Int. Cl.[7] ..... F02M 37/04

[52] U.S. Cl. ..... 123/467; 123/198 DB

[58] Field of Search ..... 123/467, 516, 123/198 DB, 198 D, 456

[56] References Cited

U.S. PATENT DOCUMENTS

| | | | |
|---|---|---|---|
| 2,734,496 | 2/1956 | Hammond | 123/198 DB |
| 3,351,288 | 11/1967 | Perr . | |
| 3,544,008 | 12/1970 | Reiners et al. . | |
| 4,296,718 | 10/1981 | Baugh | 123/198 DB |
| 4,319,550 | 3/1982 | Ishii | 123/198 DB |
| 4,361,121 | 11/1982 | Clemens | 123/198 DB |
| 4,391,241 | 7/1983 | Dohshita | 123/198 DB |
| 4,811,710 | 3/1989 | Schmitt | 123/198 DB |
| 4,957,084 | 9/1990 | Kramer | 123/198 DB |
| 4,984,554 | 1/1991 | Ariga | 123/516 |
| 5,074,272 | 12/1991 | Bostick | 123/516 |
| 5,076,227 | 12/1991 | Krieger | 123/198 DB |
| 5,159,911 | 11/1992 | Williams et al. . | |

FOREIGN PATENT DOCUMENTS

| | | | |
|---|---|---|---|
| 0200663 | 12/1982 | Japan | 123/516 |
| 0048768 | 3/1983 | Japan | 123/516 |

*Primary Examiner*—Carl S. Miller
*Attorney, Agent, or Firm*—Nixon Peabody LLP; Charles M Leedom, Jr

[57] ABSTRACT

A pump system for preventing hot start knock in a diesel engine following engine shut down carried by fuel leakage into one or more of the combustion chambers of a multiple-cylinder internal combustion engine equipped with a fuel system including open nozzle injectors connected with a common rail. The system includes a transfer pump (46) in fluid communication with the common rail (50) and the fuel tank (48) for pumping fuel out of the common rail and into the fuel tank. A transfer pump control module (82) is provided for actuating the transfer pump (46) for a period of time following engine shut down to remove a sufficient amount of fuel from the common rail to prevent fuel from leakage through the open nozzles. The control system module may include a timer (96) and a voltage sensor (86) to sense condition of a fuel shut off valve (64). A retrofit kit (FIG. 5) is provided including a control module bracket (98) and a transfer module bracket (102).

21 Claims, 8 Drawing Sheets

PUMP SYSTEM FOR PREVENTING HOT START KNOCK IN A DIESEL ENGINE

RELATED APPLICATION

This application claims the benefit of Provisional Application Serial No. 60/056,236 filed Aug. 28, 1997.

TECHNICAL FIELD

The present invention relates to fuel systems for internal combustion engines including open nozzle fuel injectors and specifically to a pump and control system for preventing engine knock upon start up.

BACKGROUND OF THE INVENTION

Some diesel engines suffer from a problem called "hot start knock" and "hot start stall" as described in the background section of U.S. Pat. No. 5,159,911 to Williams et al. and assigned to the same assignee, Cummins Engine Company, Inc., as the subject application. In particular, multi-cylinder diesel engines equipped with open nozzle unit injectors of the type disclosed in U.S. Pat. Nos. 3,351,288 and 3,544,008 can experience "hot start knock" or "hot start stall" as a result of diesel fuel leaking into some of the engine cylinders. The severity of the problem is dependent primarily on starting system capability, engine temperature, type of fuel and compression ratio. An associated problem can be excessive smoke and noise even if start up is successful.

During cranking after a hot shutdown, subsequent restarts can be accompanied by a loud series of knocks or stalls which may hurt the starting circuit. Thus, hot start knock or hard starting occurs when an engine is keyed off and restarted when warm (under 15 minutes). Several loud bangs may be heard (hot start knock), or the engine may be hard to start or fail to turn over (hard starting or cranking stall). The root cause of the problem is that a very small quantity of fuel (about 10 drops or 15 milliliters) dribbles, from the metering side of the fuel system, into the combustion chamber of one or two cylinders at hot shutdown. In a typical 6 cylinder combustion ignition engine equipped with open nozzle unit injectors, two cylinders are open at shutdown, allowing this small quantity of fuel to fall into their respective piston bowls. Under cold start conditions, this fuel condenses and is burned off after the engine is restarted. However, under hot shutdown conditions, this fuel vaporizes and creates a combustible mixture which remains in the combustion chamber. Overhead fuel tanks, drain line check valves or excessive drain line restriction seem to make this problem worse. While there is no evidence that this problem shortens engine life or causes permanent engine damage nor detrimental to engine performance, reliability or durability, it is, however, annoying and can lead to some starter motor difficulties if the starter torque is insufficient to crank the engine through the hot start knock events.

While there are devices, such as normally open fuel shut off valves (FSOV), which are effective for eliminating hot start knock on non-overhead tank applications, there is no device available to eliminate hot start knock on overhead tank applications. A normally open FSOV, when de-energized during shutdown, would permit fuel to flow from the higher fuel tank to the engine and cause hydraulic lockup of several cylinders. This has been a limiting factor in applying existing countermeasures to overhead tank applications having vertical tanks. In the non-overhead tank application, the normally open fuel shut off valve is connected between the rail tee and gear pump suction. At key-off the valve opens and allows about 10–15 ml of fuel to vent back to gear pump suction and to the fuel tank. It has been discovered that the normally open valve can be misapplied and has an inherent problem that a non-vented or overhead tank can cause hydraulic lockup of the engine. For example, some engine installations such as marine or over the road vehicle may take on an effective "overhead" fuel tank configuration if the tank is full and the engine installation is inclined by more than 30°. A delay algorithm may be used to delay FSOV opening until during cranking (not immediately at key-on) to allow timing rail to vent to timing circuit during cranking (working above 100 rpm, 100° F. coolant temp).

However, the normally open FSOV approach creates concerns about misapplication, angularity, and robustness and may not open against more than a 2 psi pressure difference across the valve.

One attempt to solve the "hot start" problem is disclosed in commonly assigned U.S. Pat. No. 5,159,911 to Williams et al. wherein a fuel leakage prevention system is disclosed including a vacuum chamber which is adapted to be placed in fluid communication with the common rail upon engine shut down. Another approach is disclosed in U.S. patent application Ser. No. 08/899,318 filed Aug. 13, 1997 (also assigned to Cummins Engine Company, Inc.) which discloses a variable volume chamber in fluid communication with the common rail of an engine wherein upon engine shut down the variable volume chamber is allowed to expand and thereby remove fuel from the common rail. While both of these approaches have some advantages, factors such as high relative cost, complexity, difficulty in retrofitting, reliability, and efficacy cause these solutions to be less than ideal.

A need therefor still exists for a "hot start" solution that is simple, highly reliable, easily installed either on original equipment or as a retrofit and effective.

SUMMARY OF THE INVENTION

A general object of this invention is to provide a transfer pump system for eliminating undesired leakage of fuel into the combustion chamber of an internal combustion engine by providing a pump actuated upon engine shutdown.

Another object of this invention is to provide a transfer pump system for use on an internal combustion engine equipped with a fuel system including open injector nozzles and a common rail for supplying fuel under variable pressure to control the operation of the internal combustion engine whereby some fuel is removed from the common rail upon engine shut down by operating a transfer pump for a short period of time. The transfer pump may be connected to the common rail by means of inlet and outlet lines having an auxiliary fuel shut off valve and a check valve, respectively, to reduce the possibility of fuel flowing in a reverse direction from the engine fuel tank into the common rail.

Still another object is to provide a transfer pump system for preventing fuel leakage into the combustion chambers of a multi-cylinder internal combustion engine equipped with a fuel injection system including a plurality of open nozzle injectors and a common rail for supplying fuel to the injectors from a fuel supply having a fuel tank such that upon engine shut down at least one injector may be stopped in an open nozzle condition to form a leakage path for fuel to flow from the injector's open nozzle into a corresponding engine cylinder, wherein the system includes anti-knock apparatus for preventing leakage of fuel into the cylinders of the engine subsequent to shut down by removing fuel from the common rail including a transfer pump in fluid communication with the common rail and the fuel tank for pumping fuel out of the common rail and into the fuel tank and a transfer pump control module for actuating the transfer pump for a period of time following engine shut down to allow the transfer pump to remove a sufficient amount of fuel from the common rail to prevent fuel from leaking through an open nozzle of an injector into a corresponding engine cylinder upon engine shut down.

Still another object of this invention is to provide a transfer pump kit for retrofitting onto a multi-cylinder internal combustion engine for preventing fuel leakage into the combustion chambers of the multi-cylinder internal combustion engine equipped with a fuel system including a common rail for supplying fuel to the engine from a fuel supply having a fuel tank including a transfer pump for removing fuel from the common rail following engine shut down, wherein the transfer pump has an inlet port and outlet port, a inlet line for fluidically connecting the pump inlet port to the common rail, a drain line for fluidically connecting the pump outlet port to the engine fuel tank, and a transfer pump controller for actuating the transfer pump for a period of time following engine shut down to allow the transfer pump to remove a sufficient amount of fuel from the common rail to prevent fuel from leaking into any engine cylinder upon engine shut down.

Other more specific objects of this invention include a retrofitable kit having appropriate mounting brackets, connectors and fasteners to allow the disclosed transfer pump system to be retrofitted onto an existing engine.

A more specific object of this invention is to provide a fuel leakage prevention system for eliminating undesired leakage of fuel into the cylinders of an internal combustion engine of the compression ignition type and equipped with open nozzle unit injectors located adjacent each cylinder wherein the system includes a pump, actuated upon engine shutdown, for removing a small quantity of fuel from the common rail supplying fuel to each of the unit injectors.

A still more specific object of this invention is to provide a transfer pump including an electric drive motor and a transfer pump controller including a voltage sensor for determining engine shut down when the voltage supplied to the engine shut off valve is changed and a relay for connecting the transfer pump drive motor to the source of electric power when the voltage sensor determines that the engine has been shut down and a timer for opening the relay to remove the transfer pump drive motor from the source of electrical power after a predetermined time interval following initial shut down of the engine.

Other and more specific objects of the invention may be understood from an examination of the following Brief Description of the Drawings and Detailed Description of the Preferred Embodiment

DETAILED DESCRIPTION OF THE PREFERRED EMBODIMENT

Figure 1D:
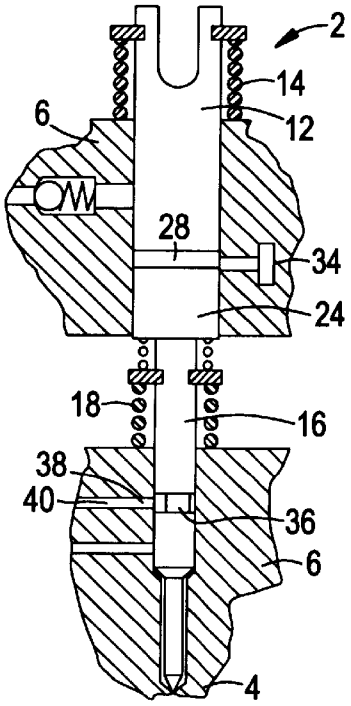
FIGS. 1A through 1D are schematic illustrations of a prior art type, open nozzle, unit fuel injector in various phases of operation that give rise to the need for the knock prevention system of the subject invention.

The subject invention is designed to solve the problem of undesirable fuel leakage into the combustion chambers of an internal combustion engine equipped with a fuel system including unit injectors having open nozzles of the type developed by the assignee of this invention, Cummins Engine Company, Inc. Throughout this application, the words "inward", and "outward" will correspond to the directions, respectively, toward and away from the point at which fuel from an injector is actually injected into the combustion chamber of the engine. For a better understanding of this type of fuel injection system, reference is made to FIGS. 1A through 1D in which are illustrated schematically the various phases of operation of a typical cam operated, unit injector 2 having an open nozzle 4 through which fuel, in metered quantities, is periodically injected into an associated combustion chamber (not illustrated) of an internal combustion engine. Examples of this type of injector for use in a fuel system for compression ignition engines are disclosed in much greater detail in PCT Application WO 97/06364 to Peters et al. and SAE Technical Paper 961748 entitled "Cummins Quantum CELECT Fuel System Description for the QSK19 Diesel Engine" incorporated herein by reference. Each such injector includes an injector body assembly 6 containing a central bore 8 within which is mounted for reciprocal movement a plunger assembly 10.

The plunger assembly 10 includes an outer plunger 12 biased outwardly by a outer return spring 14 and periodically displaced inwardly, in synchronization with the reciprocal movement of the engine piston (not illustrated) within the cylinder into which the injector is mounted to inject fuel. The plunger assembly 10 also includes an inner plunger 16 biased outwardly by an inner return spring 18 to form a metering chamber 20 at the inner end of central bore 8. As will be explained more fully below, fuel metered into metering chamber 19 is forced through a plurality of small orifices 22 formed in the inner portion (that is the portion which forms the open nozzle 4) of the injector body assembly 6 into the combustion chamber of the associated engine cylinder. The exact timing of the injection event may be varied depending on the length of a hydraulic link formed in the plunger assembly 10 on a cycle by cycle basis between outer plunger 12 and an intermediate timing plunger 24.

Figure 1C:
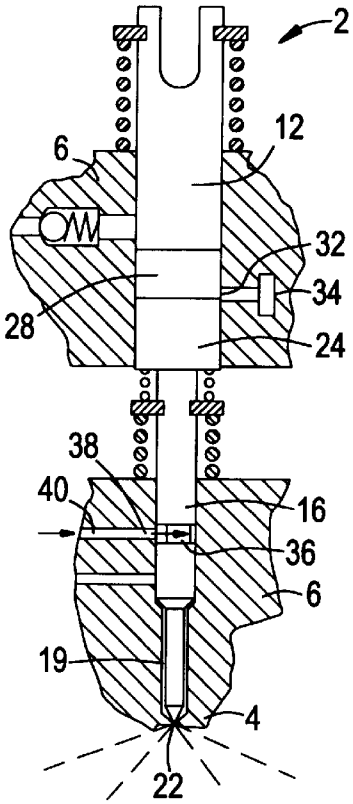
Figure 1B:
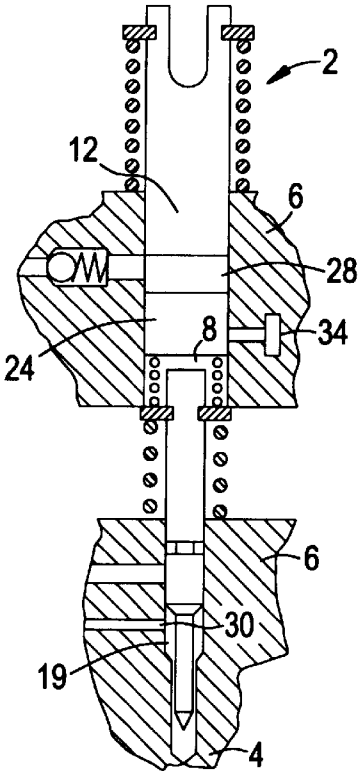
Figure 1A:
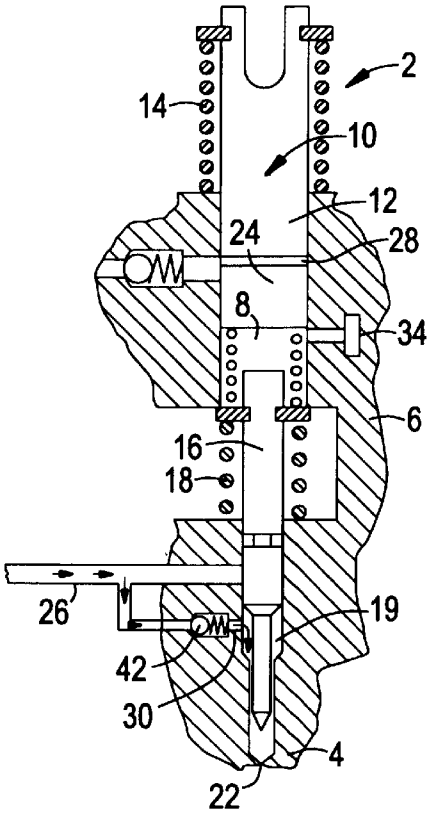

The amount of fuel injected and the timing of each injection event during each cycle of injector operation is controlled by pressure/time (PT) principles as can be understood more clearly by referring specifically to FIG. 1A. In particular, fuel is supplied to each injector through a common fuel supply rail 26 which may take the form of a drilling formed in the head (not illustrated) of the engine. A metering orifice (not illustrated) is typically included in the fuel flow path supplying each metering chamber 19 to cause the fuel quantity to be dependent on the pressure P of the fuel in the common rail 26 and the amount of time T that the fuel is metered. Similarly the amount of timing fluid (which may be engine fuel) that is metered into the timing chamber 28, formed between the outer plunger 12 and the intermediate timing plunger 24, may be controlled in the same manner. Variation in the pressure of the fuel supplied to common rail 26 can be controlled hydromechanically or by electronic means such as taught in U.S. Pat. Nos. 4,971,016 to Peters et al. and 4,532,893 to Day et al. both of which are assigned to the assignee of this invention, the Cummins Engine Company, Inc., and are incorporated herein by reference. The pressure of the timing fluid may be varied in the same manner as illustrated in the '016 Peters et al. patent.

As illustrated in FIG. 1A, the metering phase of injector operation continues until the associated cam (not illustrated) causes the outer plunger 12 to advance inwardly as illustrated in FIG. 1B to first cut off metering of timing fluid in timing chamber 28 thereby forming a hydraulic link within the timing chamber whose length is determined by the amount of timing fluid that was metered into the timing chamber 28.

Further advance of the outer plunger 12, as illustrated in FIG. 1B, causes the intermediate timing plunger 24 to advance into engagement with the inner plunger 16 to cause inner plunger 16 to advance inwardly thereby terminating fuel metering as the fuel metering port 30 is closed. Again the amount of fuel metered into the metering chamber 19 will depend on the pressure of the fuel in the common rail 26 and the time that the metering was permitted to continue.

As outer plunger 12 advances further in response to cam rotation, the fuel in metering chamber 19 is subjected to very high pressure (12,000 to 18,000 psi or higher) to cause fuel to be forced through the injection orifices 22 as illustrated in FIG. 1C. When inner plunger 16 reaches its inward most position, intermediate timing plunger 24 is arranged to clear a spill port through which the timing fluid will be spilled to drain 34. By providing an appropriate constriction in the spill path, the timing fluid can be subjected to a controlled pressure which will have the effect of applying a force to the inner plunger 16 tending to hold the timing plunger down.

After the timing chamber 28 is fully collapsed, additional rotation of the injector cam will cause the plunger assembly to retract under the force of inner return spring 18 and outer return spring 14 as illustrated in FIG. 1D. Once fully retracted, the cam is formed to cause the outer plunger to be held in the fully retracted position as illustrated in FIG. 1A to allow metering of both fuel and timing fluid to commence the next cycle of injector operation.

When the inner plunger 16 reaches its inner most position as illustrated in FIGS. 1C and 1D, an annular recess 36 formed in the inner plunger is caused to align with a scavenge port 38. Fuel from the common rail is supplied through a branch 40 to cause fuel to flow through the fuel supply and drain passages of the injector to scavenge gases and to cool the injector.

As is apparent from FIGS. 1A and 1B, metering chamber 19 is fluidically connected with both the common rail 26 and the associated combustion chamber (not illustrated) through injection orifices 22 whenever the plunger assembly 10 is retracted. A check valve 42 may be placed in the fuel feed path upstream of the metering port 30 but this is only effective to provide some isolation against combustion gases entering the common rail 26. Fuel is still permitted to flow from common rail 26 into the metering chamber 19 and to dribble or leak into the combustion chamber whenever the engine is stopped while the injector plunger assembly is in the position shown in FIGS. 1A and 1B. Should the fuel within rail 26 remain under residual pressure upon engine shut off, the migration of fuel into all open nozzle injectors whose inner plungers are retracted are likely to experience at least some leakage of fuel into the associated combustion chamber.

As explained in detail above in the Background, any fuel that leaks into a combustion chamber can cause difficulty upon restarting of the engine. This problem is especially acute when the engine is restarted while still warn from previous use. Hot start problems are particularly prevalent when an engine is restarted after less than 10 minutes such as occurs frequently when the engine is used on a delivery truck or other vehicle that is frequently stopped and started. Even greater difficulty arises when the engine is installed with an overhead fuel tank used in certain off highway industrial applications. Such applications employ a 5 psi check valve to resist normal scavenging and thus the amount of fuel that is leaked upon shut off by open injectors is increased.

Figure 2:
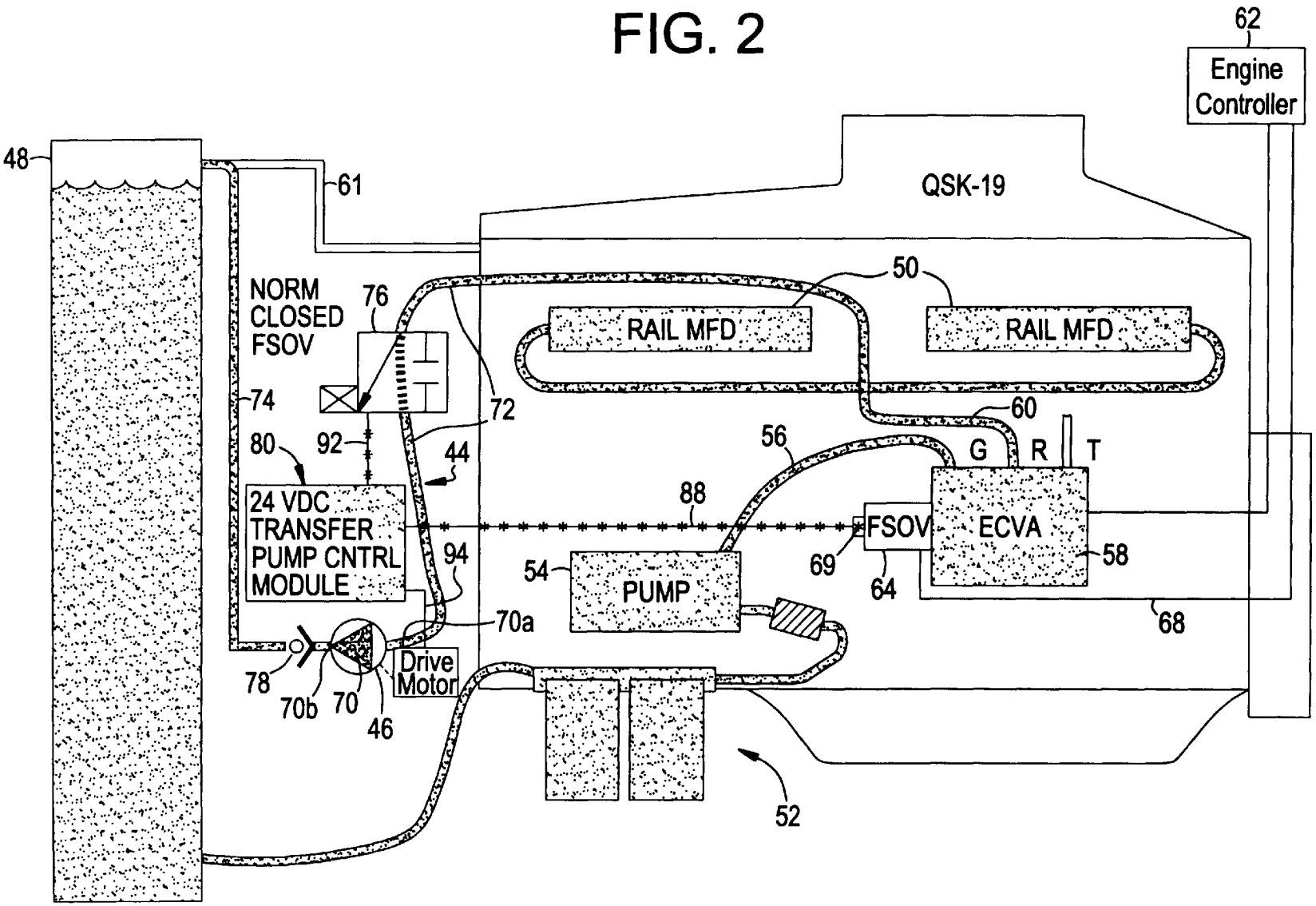
FIG. 2 is a schematic diagram of an transfer pump and control system designed in accordance with the subject invention.

Referring now to FIG. 2, the pump and control system of the present invention, indicated generally at 44, is illustrated schematically in association with a compression ignition engine 45 such as manufactured by the Cummins Engine, Inc. under the designation QSK-19. The pump and control system includes a transfer pump means 46 in fluid communication with the engine's common rail 50 and the engine's fuel tank 48. The transfer pump means 46 operates to pump fuel out of the common rail 50 and back to the engine's fuel tank 48 upon engine shut down as will be explained in greater detail below. The common rail 50 communicates with each of the engine's fuel injectors to supply fuel under varying pressure to control engine operation. The injectors are not illustrated but may be of the variable timing type schematically illustrated in FIGS. 1A through 1D. Fuel under varying pressure may be supplied to common rail 50 by the engine's fuel system 52 including a fuel pump 54 fluidically connected to the fuel tank 48. Fuel pump 54 supplies fuel through supply line 56 to an electronic control valve assembly 58 (ECVA) which operates to supply fuel to the common rail 50 through a supply branch 60. The pressure of the fuel supplied to common rail 50 may by varied in response to a variety of engine operating conditions such as throttle position, engine speed, temperature etc. all as explained more thoroughly in U.S. Pat. No. 4,971,016 to Peters et al. Although not illustrated, electronic control valve assembly 58 may also provide timing fluid (which may be engine fuel) through port T to a timing rail (not illustrated) to control the timing of injection as further taught in the '016 Peters et al. patent. At least some of the fuel supplied to the individual injectors is returned to the engine's fuel tank, as also explained in the '016 Peters et al patent, via drain pathway including a fuel drain passage 61 extending between the engine and the fuel tank 48.

An electronic engine controller 62 (such as the ECU of the '016 Peters et al. patent) may be provided to produce the electronic signals necessary to cause the electronic control valve assembly 58 to produce the desired variation in pressures in the fuel and timing fluid to vary engine operation as desired. An engine fuel shut off valve 64 is also provided to cut off the path of fluid communication between fuel pump 54 and common rail 50 to shut down engine operation as desired. The engine fuel shut off valve 64 may be a standard production component manufactured by Cummins Engine Company, Inc. and distributed as part no. 3348591. An electrical control signal is provided by engine controller 62 to engine fuel shut off valve 64 in the form of a shut down signal supplied to the engine fuel shut off valve 64 via electrical conductor 68. This shut down signal has the effect of causing a change in voltage at one terminal 69 associated with engine fuel shut off valve 64. Terminal 69 provides a conveniently accessible connection location for attaching an electrical conductor that can be used by the pump and control system 44 to determine that the engine has been shut down as will be explained more fully below.

The transfer pump means 46 may take the form of any type of pump which is capable of removing fuel from common rail 50 upon engine shut down. For example the transfer pump 70 may take the form of a production "after-market" in-line electric motor driven pump which provides a source of vacuum to pump the withdrawn fuel back to the engine's fuel tank 48 that may even be an overhead mounted fuel tank. The transfer pump 70 may be any suitable pump capable of achieving the desired purpose such as an electric motor driven pump manufactured by Federal Mogul and distributed by Cummins Engine Company, Inc. as part no. 3348646. This particular pump is a high volume component and is therefore inexpensive. Also, this pump is available in a 24 volt version and can be modified to meet industrial requirements that are determined by the circumstances in which the engine is designed to operate.

Transfer pump 70 includes a pump inlet port 70*a* connected to the common rail 50 by inlet line 72 and a pump outlet port 70*b* connected to the fuel drain passage 61 of the engine's fuel system by an outlet line 74.

In operation, the transfer pump 70 operates to aspirate the common rail and suck a small quantity of fuel (10–15 milliliters) right after shutdown to prevent fuel from dribbling into the cylinders. This fundamental approach has been tested many times by Cummins Engine Company, Inc. and has been found to operate acceptably under most circumstances. The present system is applicable to both overhead and non-overhead tank systems. For overhead tank applications, there is not an existing source of vacuum (such as gear pump suction in non-overhead tank applications) at shutdown. The transfer pump 70, therefore, functions to provide the suction. As will be explained further below, the 24 volt transfer pump 70 may be controlled to operate for a very short time (e.g. 6 to 15 seconds after shut down, that is "key-off") and then remains off until the next key-off event.

The pump and control system 44 of this invention may also include a normally closed auxiliary shut off valve 76 which isolates the transfer pump 70 from the common rail 50 during normal engine operation. The auxiliary shut off valve 76 may be the same type of valve as engine fuel shut off valve 64 which experience has shown operates reliably in most circumstances. Auxiliary shut off valve 76 may be mounted in inlet line 72 and is normally closed except when transfer pump 70 is in operation as will be explained further below. By normally operating auxiliary shut off valve 76 in a closed condition, the opportunity for fuel to flow in reverse from the fuel tank into common rail 50 will be minimized even where the fuel tank is mounted (or becomes oriented) in an overhead location relative to the engine. To further decrease the possibility of undesirable reverse flow, a check valve 78 may be placed in outlet line 74. Check valve 78 may take the form of a standard fuel line check valve now distributed by Cummins Engine Company, Inc. for all overhead tank applications.

Figure 3:
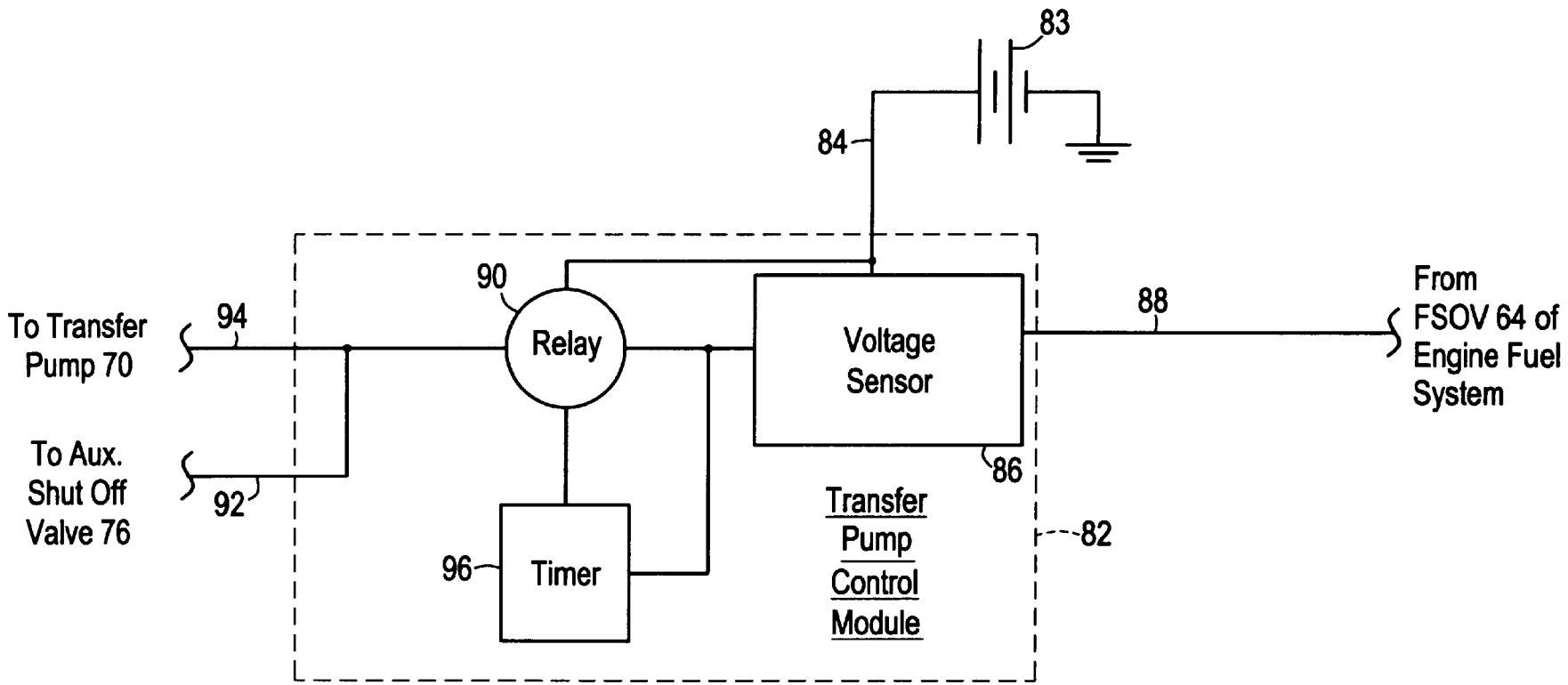
FIG. 3 is a schematic diagram of the a transfer pump control module for controlling the operation of the transfer pump and control system in accordance with the subject invention.

The pump and control system 44 may include a transfer pump control means 80 which may take the form of any type of transfer pump controller for actuating the transfer pump 70 for a period of time following engine shut down to allow the transfer pump to remove a sufficient amount of fuel from the common rail 50 to prevent fuel from leaking through an open nozzle of an injector into a corresponding engine cylinder upon engine shut down. Any type of control circuit that is capable of performing this function will be suitable. As a specific example, FIG. 3 illustrates a schematic of a transfer pump control module 82 that would be suitable This module may take the form of a custom small, potted electronics module (for example, a module made by UEC Electronics specifically for Cummins Engine Company, Inc. and distributed by Cummins as part no. 3348636). The module draws power from the engine battery 83 through conductor 84 and senses the voltage at terminal 69 of the engine fuel shut off valve 64 by means of a voltage sensor 86 connected to terminal 69 by a conductor 88. Voltage sensor 86 forms a valve closure detection means for determining when the engine is shut off. Numerous other types of sensors could be used to determine engine shut off provided that engine shut off was reliably indicated.

The transfer pump control module is about the size of a small matchbox and is mounted on a bracket which supports other components as will be described below. The transfer pump control module 82 is made from off-the-shelf components and is extremely reliable and durable. In particular, the transfer pump control module 82 may further include a relay 90 connected to both the auxiliary shut off valve 76 and the electric motor driven transfer pump 70 by separate conductors 92 and 94, respectively. To limit the period of operation of the transfer pump 70, a timer 96 is provided in the transfer pump control module 82 connected to the voltage sensor 86 and relay 90 for causing relay 90 to remove energizing power from transfer pump 70 and to allow auxiliary shut off valve 76 to re-close after a predetermined period of time has elapsed such as 6–15 seconds.

Together, transfer pump means 46 and transfer pump control means 82 form an anti-knock means for preventing leakage of fuel into the cylinders of the engine subsequent to shut down by removing fuel from the engine's common rail. During operation, upon "key-off", the transfer pump control module 82 will sense a voltage drop on terminal 69 of the engine fuel shutoff valve 64. The module energizes normally closed auxiliary shut off valve 76 and transfer pump 70 simultaneously. The transfer pump 70 draws a small vacuum on the common rail 50 and removes about 10–15 milliliters (about 10 drops) of fuel. This prevents the fuel from dribbling into the cylinders and completely eliminates hot start knock or starter stall tendencies. The transfer pump 70 sends this small quantity of fuel back through the outlet line 74 and check valve 78 to the fuel drain passage 61 and eventually back to the fuel tank 48. The transfer pump 70 and auxiliary shut off valve turn off and re-close, respectively, after the predetermined time as determined by timer 96, for example after about 6 to 15 seconds. The transfer pump 70 is designed to overcome a 10' head and can work for non-overhead tanks as well. The system is completely automatic and requires no operator intervention or attention.

Figure 4:
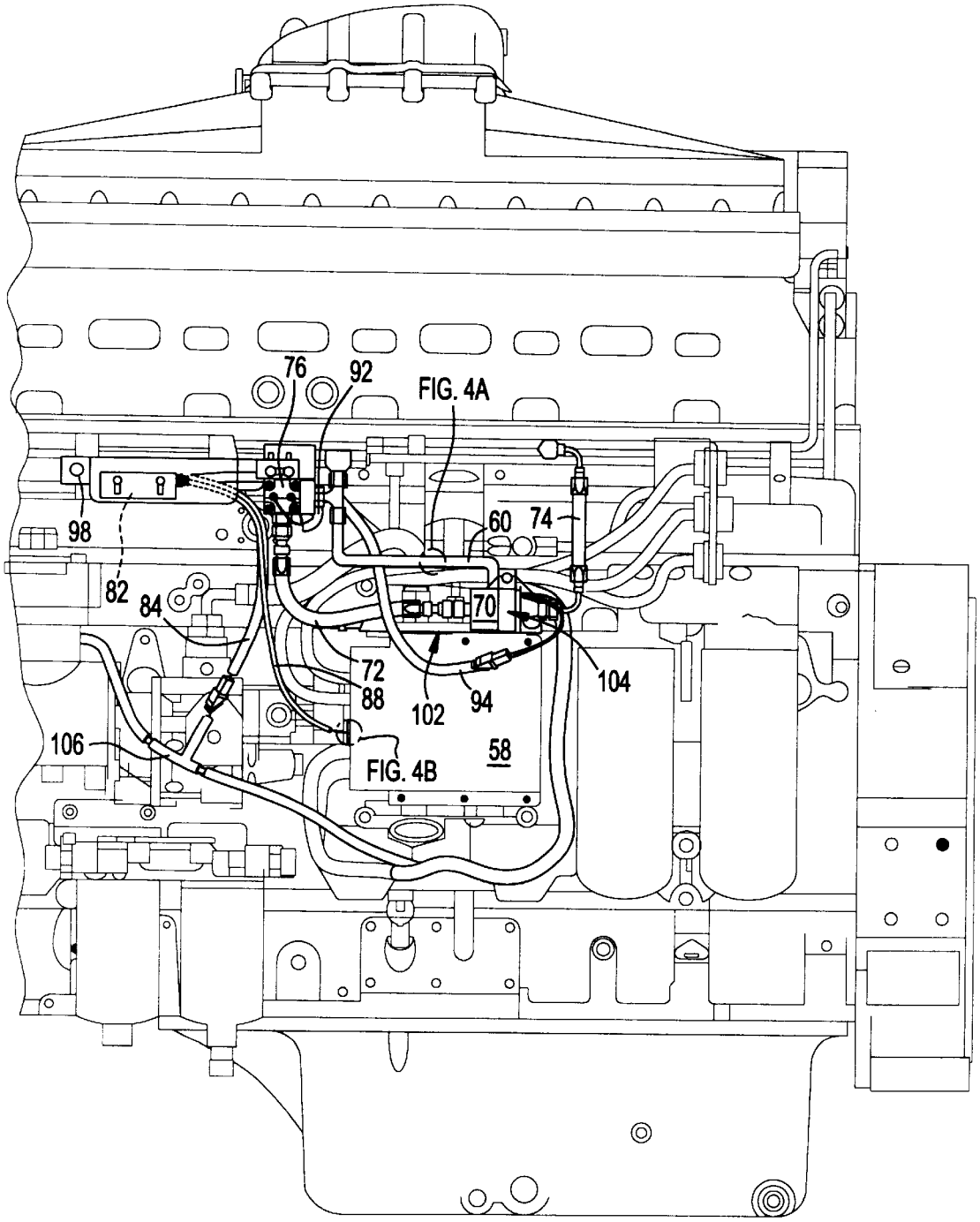
FIG. 4 is a side elevational view of one embodiment of the transfer pump and control system designed in accordance with the subject invention when mounted on an internal combustion engine.
Figure 4A:
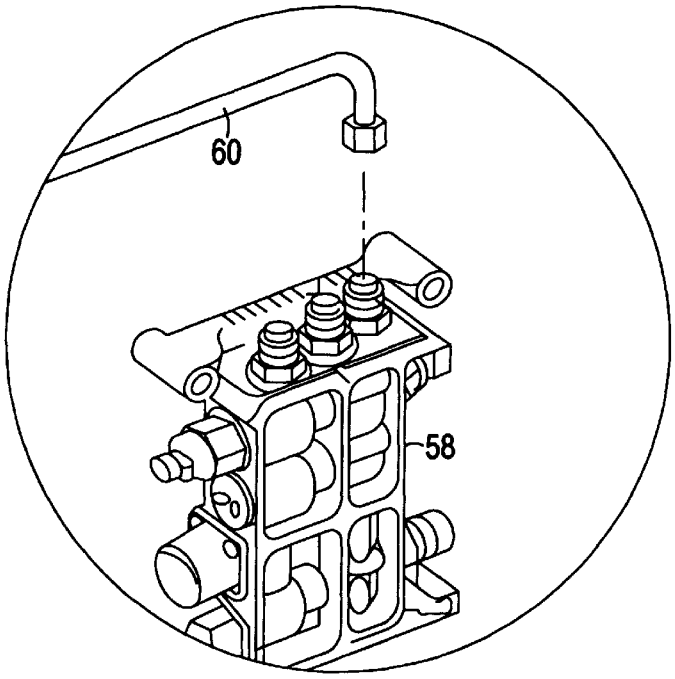
Figure 4B:
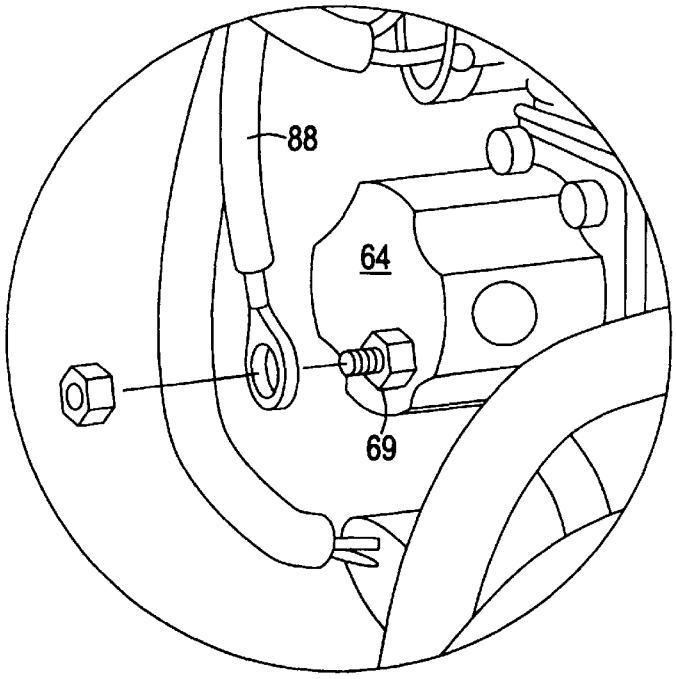

FIG. 4 illustrates one example of an embodiment of the transfer and control pump system designed in accordance with the subject invention as it might be mounted on a commercially available engine such as a QSK-19 engine manufactured by the Cummins Engine Company, Inc. The components illustrated in FIG. 4 are identified by the same reference numerals as were used to identify corresponding components illustrated in FIGS. 2 and 3.

Figure 5:
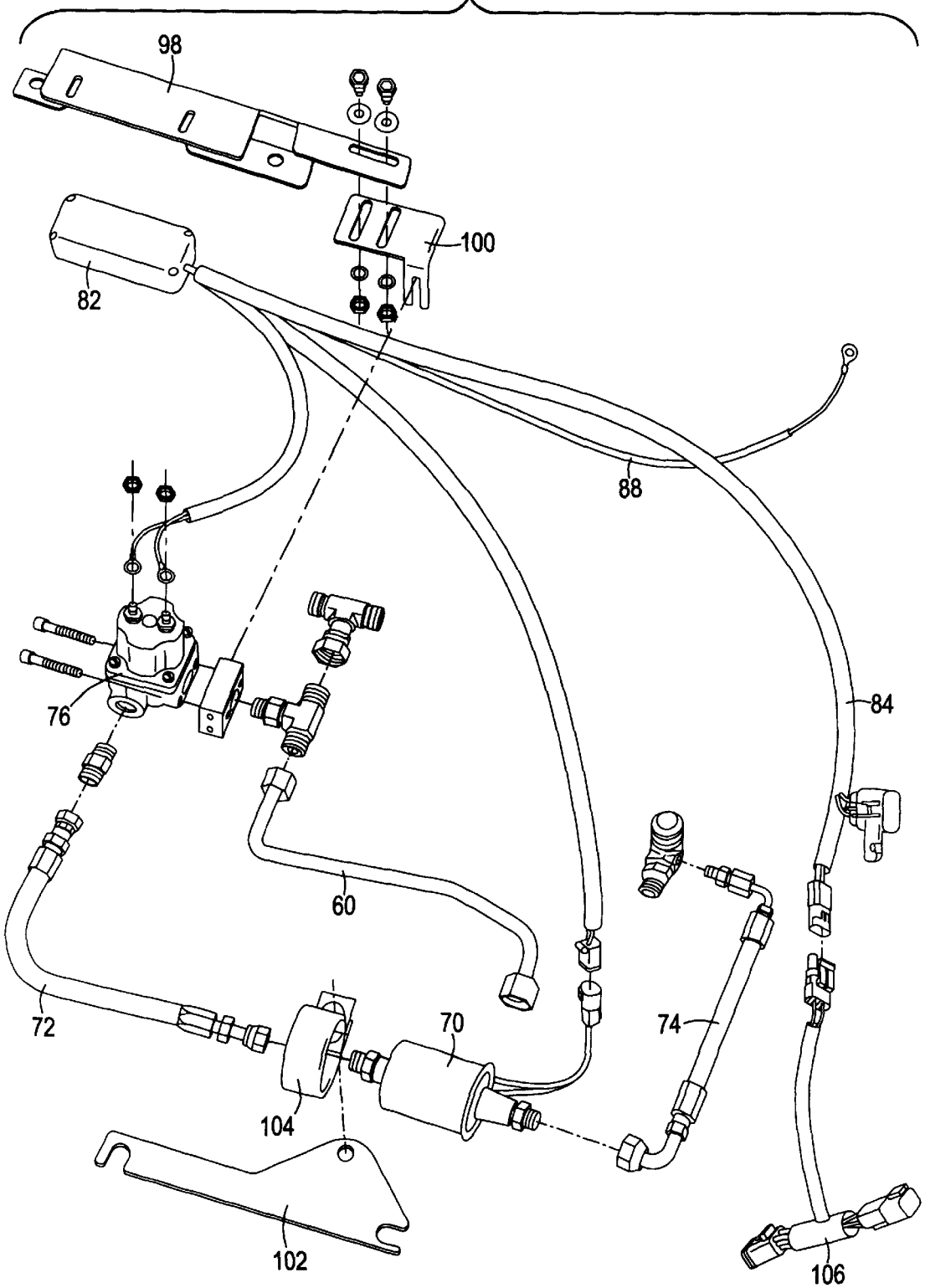
FIG. 5 is an exploded perspective view of a transfer pump and control system in the form of a kit adapted to be retrofitted onto an existing internal combustion engine.
Figure 6A:
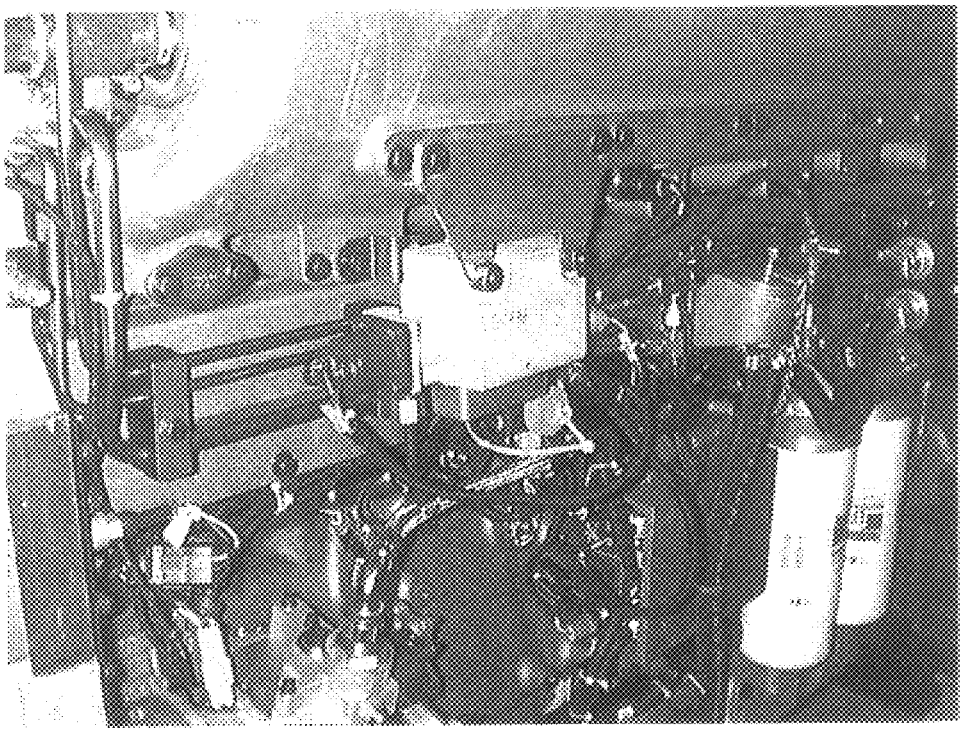
FIGS. 6A through 6D are perspective views of a transfer pump and control system designed in accordance with the subject invention as it would appear when mounted on a prior art internal combustion engine.
Figure 6B:
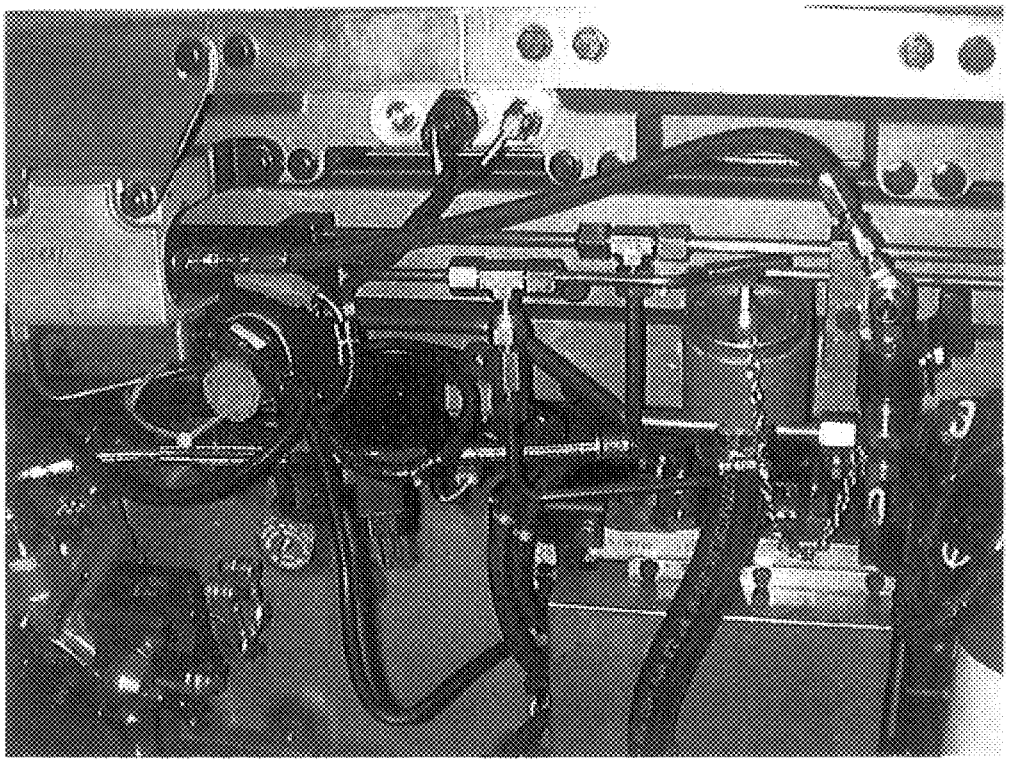
Figure 6C:
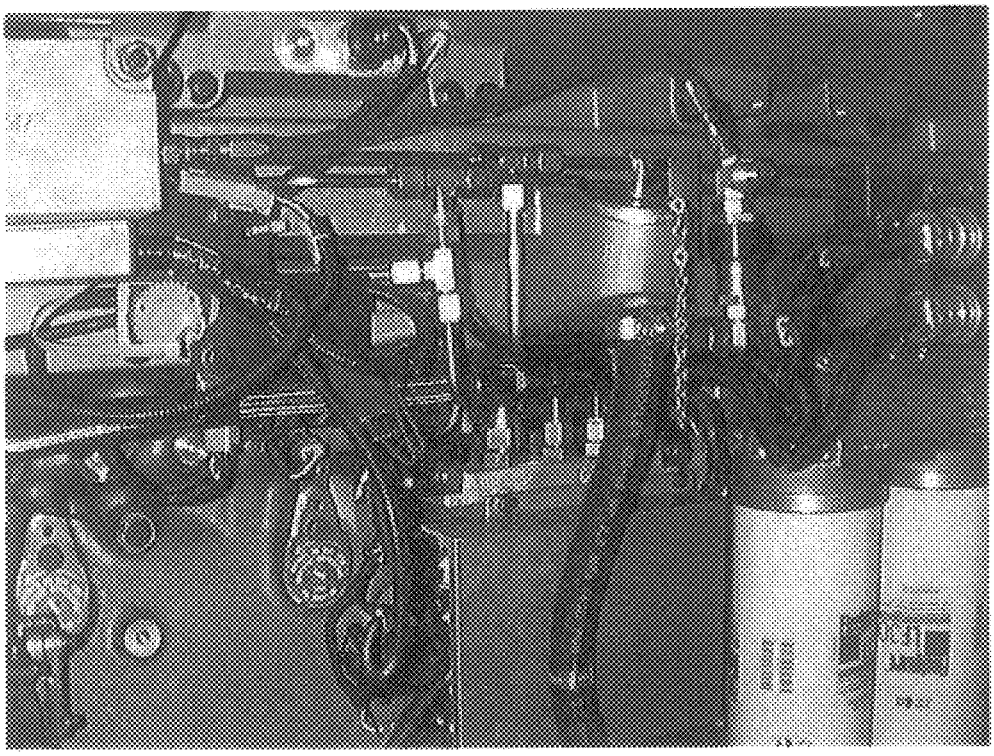
Figure 6D:
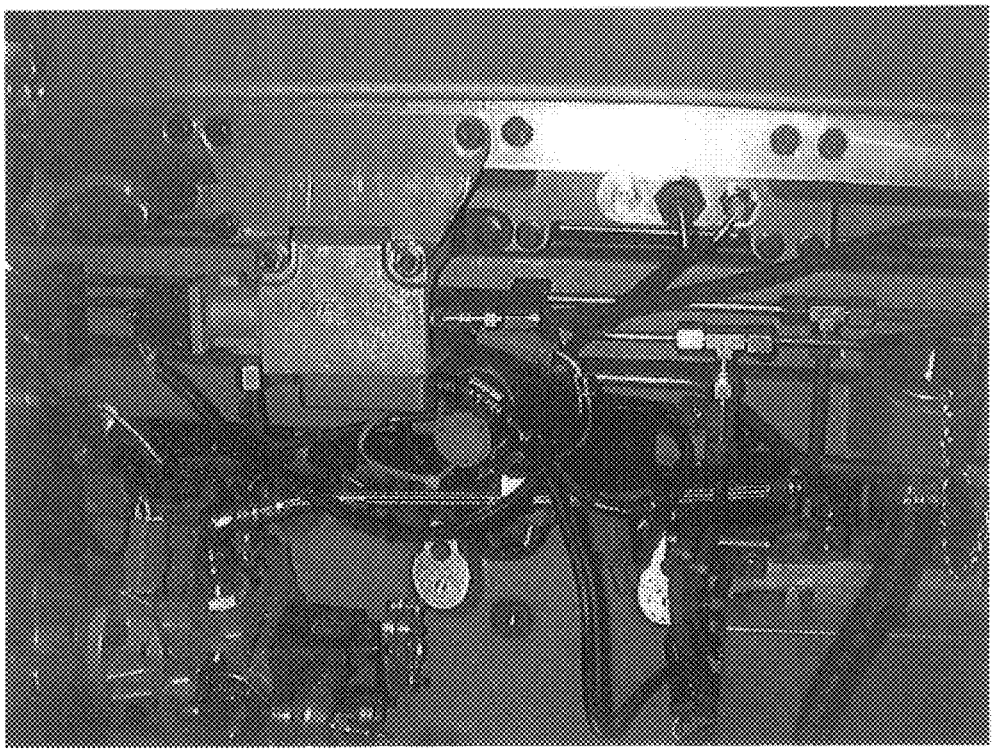

FIG. 5 illustrates, in exploded perspective, a kit for retrofitting a transfer pump onto a multi-cylinder internal combustion engine for preventing fuel leakage into the combustion chambers of the multi-cylinder internal combustion engine equipped with a fuel system including a common rail for supplying fuel to the engine from a fuel supply having a fuel tank. The elements described above with respect to FIGS. 2–4 that are included in the kit are labeled with the same reference numerals. In addition, the transfer pump control module 82 is mounted to the engine by a module bracket 98 (also illustrated in FIG. 4) and auxiliary fuel shut off valve 76 is mounted by means of a valve bracket 100. A transfer pump bracket 102 and associated clip 104 is illustrated for mounting the fuel transfer pump 70 of the engine. These additional brackets are also illustrated in FIG. 4. A power splice 106 is provided to connect conductor 84 to a source of electrical power on the engine. Various additional couplings, connectors and fasteners necessary to form a practical retrofittable kit are illustrated in FIG. 5.

FIGS. 6A through 6D disclosure additional views of how the transfer pump and control system, designed in accordance with the subjection invention, would appear when installed on an engine.

The present system/device effectively eliminates hot start knock, works robustly under all conditions (low idle, high idle shutdown warm, cold) and is transparent to performance, emissions, controls, and startability. The system imparts no starting delay or surge to engine operation. Also, the present system/device is inexpensive, causes no harm to the engine, does not impact the existing electronics, packages easily and compactly on the engine, and works for both overhead and non-overhead tanks. Also, the device does not leak externally, is safe, reliable, and durable. Moreover, this system can be provided as a "kit" and easily retrofited on existing engines with installation taking less than 1 hour.

Other significant and important advantages of the disclosed invention can be ascertained from a consideration of the above description of the preferred embodiments. Variations and substitutions can be made for any of the disclosed components so long as the intended purposes of those components are achieved by the variations and substitutions made. For example, the engine would not necessarily need to be equipped with an open nozzle fuel system to benefit from the advantages of the subject invention. The type of transfer pump, fuel shut off valve and the details of the control module could all be altered and still implement the broader aspects of this invention.

What is claimed is:

1. A transfer pump system for preventing fuel leakage into the combustion chambers of a multi-cylinder internal combustion engine equipped with a fuel injection system including a plurality of open nozzle injectors and a common rail for supplying fuel to the injectors from a fuel supply having a fuel tank such that upon engine shut down at least one injector may be stopped in an open nozzle condition to form a leakage path for fuel to flow from the injector's open nozzle into a corresponding engine cylinder and further having with an engine fuel supply system, fuel drain passage for returning fuel from the engine to the fuel tank, and a source of electric energy and a fuel supply system including a engine fuel shut off valve, an electronic control valve assembly for supplying fuel under varying pressure to the common rail to control engine operation, and an electronic engine controller for providing control signals to the electronic control valve assembly to vary the pressure of the fuel in the common rail to control engine operation and to the engine fuel shut off valve to change the voltage supplied to the engine shut off valve to shut off fuel flow into the common rail upon engine shut down, comprising:

anti-knock means for preventing leakage of fuel into the cylinders of the engine subsequent to shut down by removing fuel from the common rail, including transfer pump means in fluid communication with the common rail and the fuel tank for pumping fuel out of the common rail and into the fuel tank, wherein said transfer pump includes an electric drive motor, a drain line for connection between said transfer pump means and the fuel drain passage to allow fuel pumped out of the common rail by said transfer pump means to be returned to the fuel tank, said drain line includes a check valve for allowing fuel flow out of the common rail and for preventing reverse fuel flow into the common rail from the fuel tank, and transfer pump control means for actuating said transfer pump means for a period of time following engine shut down to allow said transfer pump means to remove a sufficient amount of fuel from the common rail to prevent fuel from leaking through an open nozzle of an injector into a corresponding engine cylinder upon engine shut down, said transfer pump control means includes a voltage sensor for determining engine shut down when the voltage supplied to the engine shut off valve is changed and a relay for connecting said electric drive motor to the source of electric power when said voltage sensor determines that the engine has been shut down and a timer for opening said relay to remove said electric drive motor from the source of electrical power after a predetermined time interval following initial shut down of the engine.

2. The transfer pump system as defined in claim 1 further including a engine shut off valve mounted within the flow path between the fuel tank and the common rail to isolate the common rail from the fuel supply, when moved from an open condition to a closed condition, to cause the engine to shut down and wherein said transfer pump control means includes a valve closure detection means for determining when the engine shut off valve is closed to actuate said transfer pump means whenever said engine shut off valve moves from its open condition to its closed condition.

3. The transfer pump system as defined in claim 2, wherein said transfer pump control means further includes timing means for de-actuating said transfer pump means within a predetermined time interval following each movement of said engine shut off valve from its open condition to its closed position.

4. A transfer pump system for preventing fuel leakage into the combustion chambers of a multi-cylinder internal combustion engine equipped with a fuel injection system including a plurality of open nozzle injectors and a common rail for supplying fuel to the injectors from a fuel supply having a fuel tank such that upon engine shut down at least one injector may be stopped in an open nozzle condition to form a leakage path for fuel to flow from the injector's open nozzle into a corresponding engine cylinder, further including an engine shut off valve mounted within the flow path between the fuel tank and the common rail to isolate the common rail from the fuel supply, when moved from an open condition to a closed condition, to cause the engine to shut down, comprising:

anti-knock means for preventing leakage of fuel into the cylinders of the engine subsequent to shut down by removing fuel from the common rail, including:

transfer pump means in fluid communication with the common rail and the fuel tank for pumping fuel out of the common rail and into the fuel tank, wherein said transfer pump means includes an electric motor driven transfer pump, and transfer pump control means for actuating said transfer pump means for a period of time following engine shut down to allow said transfer pump means to remove a sufficient amount of fuel from the common rail to prevent fuel from leaking through an open nozzle of an injector into a corresponding engine cylinder upon engine shut down, wherein said transfer pump control means includes:

a valve closure detection means for determining when the engine shut off valve is closed to actuate said transfer pump means whenever said engine shut off valve moves from its open condition to its closed condition, a timing means for de-actuating said transfer pump means within a predetermined time interval following each movement of said engine shut off valve from its open condition to its closed position, and an electrical relay for connecting said electric motor driven transfer pump to a source of electric power in response to an electrical signal indicating that the engine shut off valve has changed from its open condition to its closed condition and wherein said timing means includes an electrical timer for causing said relay to disconnect said electric motor driven transfer pump after a predetermined time interval following initial actuation of said electric motor driven transfer pump.

5. The transfer pump system as defined in claim 4 for use with an engine having a fuel supply system including a fuel drain passage for returning fuel from the engine to the fuel tank further including a drain line between said transfer pump and the fuel drain passage to allow fuel pumped out of the common rail by said transfer pump to be returned to the fuel tank, wherein said drain line between said transfer pump and the fuel drain passage includes a check valve for allowing fuel flow out of the common rail and for preventing fuel flow into the common rail through said fuel drain line.

6. A transfer pump system for preventing fuel leakage into the combustion chambers of a multi-cylinder internal combustion engine equipped with a fuel injection system including a plurality of cam operated, open nozzle unit injectors and a common rail for supplying fuel to the injectors from a fuel supply such that upon engine shut down at least one injector may be stopped in an open nozzle condition to form a leakage path for fuel to flow from the injector's open nozzle into the corresponding combustion chamber, comprising:

a fuel tank mounted to reside vertically above the common rail at certain times upon engine shut down, a fuel drain passage for returning fuel from the engine to said fuel tank, a transfer pump for removing fuel from the common rail following engine shut down, a drain line between said transfer pump and said fuel drain passage to allow fuel pumped out of the common rail by said transfer pump to be returned to said fuel tank, and a transfer pump controller for actuating said transfer pump for a predetermined period of time following engine shut down to allow said pump to remove a sufficient amount of fuel from the common rail to prevent fuel from leaking into any engine cylinder upon engine shut down.

7. The transfer pump system as defined in claim 6 for use with an engine fuel supply system having a fuel drain passage for returning fuel from the engine to the fuel tank, further including a drain line between said transfer pump and the fuel drain passage to allow fuel pumped out of the common rail by said transfer pump to be returned to the fuel tank.

8. The transfer pump system as defined in claim 6, wherein said drain line between said transfer pump and the fuel dram passage includes a check valve for allowing fuel flow out of the common rail and for preventing fuel flow into the common rail through said drain line.

9. A transfer pump system for preventing fuel leakage into the combustion chambers of a multi-cylinder internal combustion engine equipped with a fuel injection system including a plurality of open nozzle injectors and a common rail for supplying fuel to the injectors from a fuel supply having a fuel tank such that upon engine shut down at least one injector may be stopped in an open nozzle condition to form a leakage path for fuel to flow from the injector's open nozzle into the corresponding combustion chamber, and further equipped with an engine fuel supply system having a fuel drain passage for returning fuel from the engine to the fuel tank, wherein the engine fuel supply system includes a engine fuel shut off valve, an electronic control valve assembly for supplying fuel under varying pressure to the common rail to control engine operation, and an electronic engine controller for providing control signals to the electronic control valve assembly to control engine operation and to the engine fuel shut off valve to change the voltage supplied to the engine shut off valve to shut off fuel flow into the common rail upon engine shut down, comprising:

a transfer pump for removing fuel from the common rail following engine shut down, wherein said transfer pump includes an electric drive motor, a drain line between said transfer pump and the fuel drain passage to allow fuel pumped out of the common rail by said transfer pump to be returned to the fuel tank, wherein said drain line between said transfer pump and the fuel drain passage includes a check valve for allowing fuel flow out of the common rail and for preventing fuel flow into the common rail through said drain line, and a transfer pump controller for actuating said transfer pump for a predetermined period of time following engine shut down to allow said pump to remove a sufficient amount of fuel from the common rail to prevent fuel from leaking into any engine cylinder upon engine shut down, said transfer pump controller includes a voltage sensor for determining engine shut down when the voltage supplied to the engine shut off valve is changed and a relay for connecting said transfer pump drive motor to the source of electric power when said voltage sensor determines that the engine has been shut down and a timer for opening said relay to remove said transfer pump drive motor from the source of electrical power after a predetermined time interval following initial shut down of the engine.

10. The transfer pump system as defined in claim 9 further including an engine shut off valve mounted within the flow path between the fuel tank and the common rail to isolate, when moved from an open condition to a closed condition, the common rail from the fuel supply to cause the engine to shut down and wherein said transfer pump controller includes a valve closure detection means for determining when said engine shut off valve is closed to actuate said drain pump whenever said engine shut off valve moves from its open condition to its closed condition.

11. The transfer pump system as defined in claim 10, wherein said pump controller further includes a timer for de-actuating said drain pump within a predetermined time interval following each movement of said engine shut off valve from its open condition to its closed position.

12. The transfer pump system as defined in claim 11, wherein said transfer pump includes a electric motor driven pump and said transfer pump controller includes an electrical relay for connecting said electric motor driven pump to a source of electrical energy in response to an electrical signal indicating that the shut off valve has changed from its open condition to its closed condition and an electrical timing circuit for causing said relay to disconnect said electric motor driven pump after a predetermined time interval following initial actuation of said electric motor driven pump.

13. A transfer pump kit for retrofitting onto a multi-cylinder internal combustion engine for preventing fuel leakage into the combustion chambers of the multi-cylinder internal combustion engine equipped with a fuel system including a common rail for supplying fuel to the engine from a fuel supply having a fuel tank, comprising:

a transfer pump for removing fuel from the common rail following engine shut down, said transfer pump having an inlet port and outlet port;

an inlet line for fluidically connecting said inlet port to the common rail;

an drain line for fluidically connecting said outlet port to the engine fuel tank; and a transfer pump controller for actuating said transfer pump for a period of time following engine shut down to allow said transfer pump to remove a sufficient amount of fuel from the common rail to prevent fuel from leaking into any engine cylinder upon engine shut down.

14. The transfer pump kit as defined in claim 13 further including an auxiliary fuel shut off valve for normally shutting off the fluid communication between the common rail and the engine fuel tank.

15. The transfer pump kit as defined in claim 14, wherein said transfer pump controller includes a sensor for determining when the engine is shut down.

16. The transfer pump kit as defined in claim 15 for use on an engine having a electrical component whose voltage changes when the engine is first shut down from a running condition and wherein said sensor of said transfer pump controller is a voltage sensor and said kit further includes an electrical conductor for connecting said voltage sensor with the component on said engine whose voltage changes when the engine is first shut down.

17. The transfer pump kit as defined in claim 13, further including mounting means for mounting said transfer pump and said transfer pump controller on the engine.

18. The transfer pump kit as defined in claim 17 wherein said mounting means includes a first mounting bracket for mounting said transfer pump controller on the engine and a second mounting bracket for mounting said transfer pump on the engine.

19. The transfer pump kit as defined in claim 13 for use on an engine having a electrical component whose voltage changes when the engine is first shut down from a running condition, wherein said transfer pump includes an electric drive motor and said transfer pump controller includes an electronic module including:

a voltage sensor for sensing when said electrical component changes voltage, a relay for connecting said transfer pump drive motor to a source of electric power when said voltage sensor determines that the engine has been shut down, and a timer for opening said relay to remove said transfer pump drive motor from the source of electrical power after a predetermined time interval following initial shut down of the engine.

20. The transfer pump kit as defined in claim 13 for use on an engine having an source of electrical power and electrical supply conduit connected with said source of electrical power, wherein said kit includes a conductor connected at one end with said electronic module and a power splice for electrically connecting said conductor to said source of electrical power.

21. The transfer pump kit as defined in claim 14 for use with an engine fuel supply system having a fuel drain passage for returning fuel from the engine to the fuel tank, wherein said drain line is adapted for connection between said transfer pump and the fuel drain passage and said transfer kit further includes a check valve for allowing fuel flow out of the common rail and for preventing fuel flow into the common rail.

* * * * *